US005417639A

United States Patent [19]

Cronauer

[11] Patent Number: 5,417,639

[45] Date of Patent: May 23, 1995

[54] BAGS AND METHOD OF MAKING SAME

[75] Inventor: William M. Cronauer, Tallmadge, Ohio

[73] Assignee: Automated Packaging Systems, Inc., Streetsboro, Ohio

[21] Appl. No.: 133,639

[22] Filed: Oct. 7, 1993

[51] Int. Cl.[6] ..... B31B 1/14; B31B 1/60

[52] U.S. Cl. ..... 493/223; 493/196; 493/238; 493/346

[58] Field of Search ..... 493/194, 195, 196, 197, 493/198, 210, 212, 223, 224, 238, 346, 367; 53/384.1

[56] References Cited

U.S. PATENT DOCUMENTS 3,533,331 10/1970 Kugler ..... 493/194

4,337,058 6/1982 Lerner ..... 493/238

*Primary Examiner*—Jack W. Lavinder

*Attorney, Agent, or Firm*—Watts, Hoffmann, Fisher & Heinke

[57] ABSTRACT

A container strip in the form of a chain of interconnected preopened bags with openings having longitudinal dimensions of at least about 1/32 inch is disclosed. The container strip provides greatly enhanced facility for bag registration and opening during packaging operations utilizing the improved container strip. A process of forming a chain of pre-opened bags is also disclosed. Face and back plastic webs are independently fed along individual paths of travel to a common path. The webs are differentially tensioned while in their independent paths by stretching the face web more than the back web such that the face web will retract longitudinally more than the back web upon release of the web tension. While so tensioned edge seals are formed between the webs to convert the webs into a tube and longitudinally spaced transverse seals are formed between the webs to delineate bottoms of bags. Transverse lines of weakness are formed in said back web to facilitate separation of bags from the remainder of the web during a subsequent use. Tension in individual bag sections of the face web is released by forming longitudinally spaced transverse separations of the sections and thereby producing a space between each contiguous pair of sections.

13 Claims, 1 Drawing Sheet

BAGS AND METHOD OF MAKING SAME

This invention relates to chains of interconnected, pre-opened bags used in packaging and more particularly relates to a novel and improved chain of bags and method of making them.

BACKGROUND OF THE INVENTION

U.S. Pat. No. 3,254,828, issued Jun. 7, 1966, to Hershey Lerner under the title Flexible Container Strips is directed to so called bags on a roll (here the AutoBag patent). This patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, (here the Wig-Wag patent). Such container strips have been sold by Automated Packaging Systems, Inc. of Streetsboro, Ohio, the assignee of the present case, under the trademark AutoBag and have enjoyed great commercial success.

Both AutoBag and competitive products have usually been made by feeding a tube through a converting machine. Such a machine forms transverse seals to delineate the bottoms of the bags and transverse lines of weakness by perforating both layers of the tube to delineate contiguous ends of adjacent bags. After the perforations are formed, a "zinging" operation is performed on each bag to open the front of the bag while leaving the perforations of the back intact.

Relatively recently a market has developed for these chains of bags made from two layers of plastic, so that the plastic of the front of the bag is different from that of the back of the bag. For example, some customers for such bags may wish the back of the bag to be white to enhance the legibility of information imprinted on it such as instructions on how to use a product packaged in the bag. The front of the bag is clear, so that the contents of a package are readily visible. To accomplish this two single layer webs of plastic are fed from respective supplies in a manner similar to that taught in U.S. Pat. No. 4,337,058 issued Jun. 29, 1982 to Bernard Lerner under the title Method of Making a Container Strip Having Inserts. Marginal edges of the two webs are then fused together to form a tube and remainder of the container strip manufacture is identical to that when the supplied work piece is a flattened tube.

So called "multiple up" production has also become quite customary. With multiple up, the work piece may be either a relatively wide flattened tube or two relatively wide single ply sheets fed together and fused. In either event hot knives are used to sever the work piece into two or more elongate tubes and thereafter each new tube is made into a chain of pre-opened bags.

When bags are made from two single ply webs, every effort has been made to provide identical tension on the two webs, so that once made into a tube the only difference of the tube from one provided as a tubular work piece is that the front and back are not identical, such as the back may be pigmented while the front is clear. With the two single ply approach, if the bag making machine was not adjusted properly, once opened the bags would not lie flat with the separated edges which delineate the openings lying in closely juxtaposed positions. The resultant product was often scrap. If the edges were not juxtaposed but rather there was a gap between them, they were rejected because they were perceived to be unacceptable to customers as unsightly and bags which would produce packages with misaligned top edges. If the top edge of an opened bag overlapped the bottom of the adjacent bag, all too often the spark gap detector used for bag registration in a bagging machine would not function properly. Such a bagging machine is disclosed in U.S. Pat. No. 4,014,154, issued Mar. 29, 1977, to Bernard Lerner and related patents identified therein (here the H-100 patents).

SUMMARY OF INVENTION

It has now been recognized for the first time that if chains of bags are made from single ply webs that are differentially tensioned an improved and superior product can be produced.

The improved product is a flexible container strip formed of an elongated flexible tube of plastic material capable of bonding to itself at a predetermined temperature on application of pressure but being otherwise non-adherent to material of identical composition. The tube is longitudinally collapsed with face and back plies joined together along their longitudinal side edges. A plurality of spaced, transversely disposed bottom seals each secure the plies together and delineate ends of fillable bag spaces. Each seal extends transversely from one side edge of the tube to another such that the tube is separated into a chain of connected bags. The face ply of each bag has a transverse end opening extending substantially from one side edge of the bag to the other and extending longitudinally at least about 1/32 of an inch to facilitate bag opening and loading and provide access to the back ply. Each opening is adjacent the end of the bag remote from its bottom seal forming the filling space end of that bag such that the bags of the chain are all oriented in the same direction.

The openings formed in the face ply are at longitudinally spaced intervals equal to the spacing of the bottom seals. The back ply of each bag has a transversely weakened tearable portion extending substantially from one side edge to another to permit facile separation of the bags while maintaining the integrity of the back ply and the tube. Each tearable portion is aligned with and accessible through the end opening of its bag. Thus, the improved strip is a chain of collapsed bags which may be fed serially along a path from a supply to bag opening and load stations, may be readily and accurately registered at a load station through spark detector location of the tearable portions and may be opened by a blast of air directed longitudinally of the path and then loaded and separated from the chain sequentially and one at a time.

In the preferred method of manufacture the tension on the web which will become the face of the bags is carefully differentially tensioned to stretch it, without exceeding its elastic limit, more than the web which will become the back of the bags. Alternatively the back web is tensioned more than the front to exceed its elastic limit. While the differential tensioning is maintained, side seams are formed to produce a tube. Preferably the balance of the container strip formation operation is that which has been employed in the past, so that existing manufacturing equipment can be used without modification.

The improved product results when the face of a bag is "zung" to form a transverse opening delineating the top of the bag. The formation of the opening releases the tension in the face of the bag, so that the face of the bag will shrink with the result that the top edge of the just opened bag will be at least about 1/32 (one thirty second) of an inch from the bottom edge of the following adjacent bag. The resultant product not only facilitates bag opening at a load station, but also assists in reliably producing appropriate bag registration at a load station. Registration is enhanced because the perforations in the back face, being aligned with and accessible through the elongated opening, are readily, precisely and reliably detected by a spark detector.

In an alternate system for making the improved chain of bags, bottom seals and perforations are formed and the web is "zung" to separate perforations of the face web. Thereafter side seals are formed while the back web is maintained under controlled tension to produce bags having top openings of consistent and desired longitudinal extent.

Accordingly, the objects of the invention are to provide a novel and improved chain of interconnected but pre-opened bags and a method of making such a chain.

IN THE DRAWINGS

DESCRIPTION OF THE PREFERRED EMBODIMENT

Figure 4:
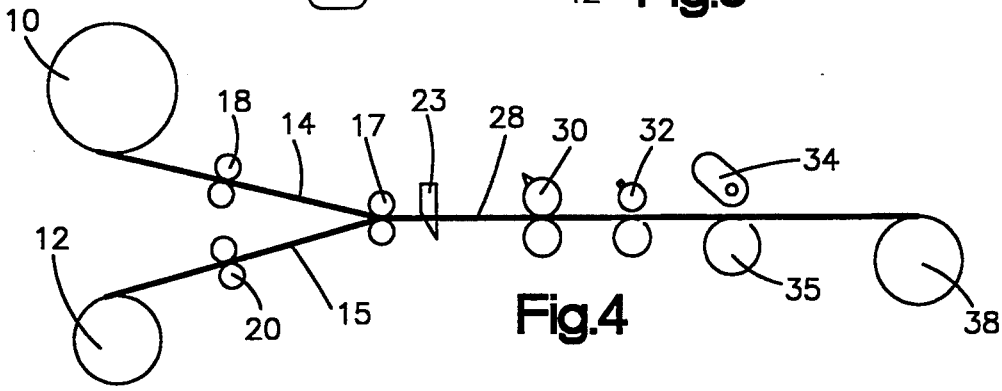
FIG. 4 is a side elevational, schematic view of a process of making a chain; and, FIG. 5 is a schematic plan view of the machine of FIG. 4.
Figure 5:
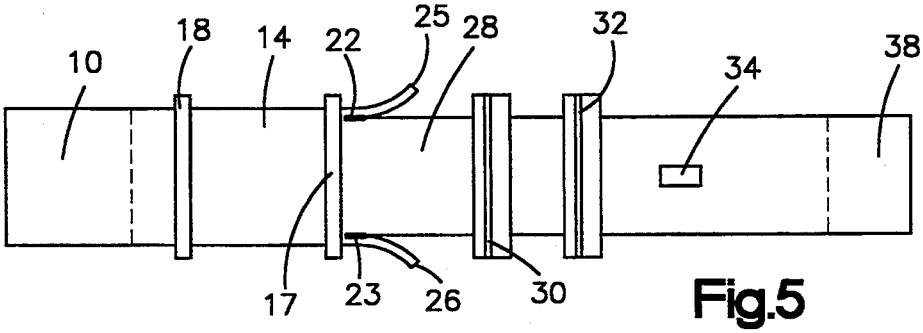

Referring now to the drawings and to FIGS. 4 and 5 in particular, a pair of single ply individual web supplies 10, 12 are provided which are face and back webs respectively. Webs from the supplies 10, 12 are respectively fed along individual paths of travel 14, 15 to a juncture at juncture nip rolls 17. Tension control nip roll sets 18, 20 are provided. The set 18 is positioned along the path 14 to tension the face web 10 while the set 20 is along the path 15 to tension the back web 12. When in operation the nip roll set 18 will be set to tension the face web to a higher level than the back web, in that the web from the supply 10 will form the face of fronts of bags being produced.

The webs are fed from the juncture nip rolls 17 along a common path of travel 28. Hot knives 22, 23 are positioned downstream from the juncture nips 17 to form bead seals along side edges of the webs and convert the webs into a tube. Trim strips 25, 26 formed by the hot knives are removed for collection and recycling.

Once formed into a tube the combined webs pass through a sealer 30 which form transverse seals to become the bottoms of the bags being produced. Next a perforator 32 forms transverse lines of weakness in the tube to delineate, in each case, a bag bottom adjacent a transverse seal and the top of an adjoining bag.

A rotating finger known as a "zinger" 34 is provided. The zinger has a surface speed slightly greater than the speed of the web so that as the zinger 34 strikes a section of the web that will be the front of a bag, acting against the resistance of an anvil roll 35, it separates the perforations of the front web to form a bag opening. Thereafter the web, now formed into a container strip of interconnected but open bags, is collected at a take up 38. Apart from the adjustment of the tension control nips 18, 20 to provide differential tensioning, the machine and the process thus far described are now conventional and well known to those in the art.

Figure 1:
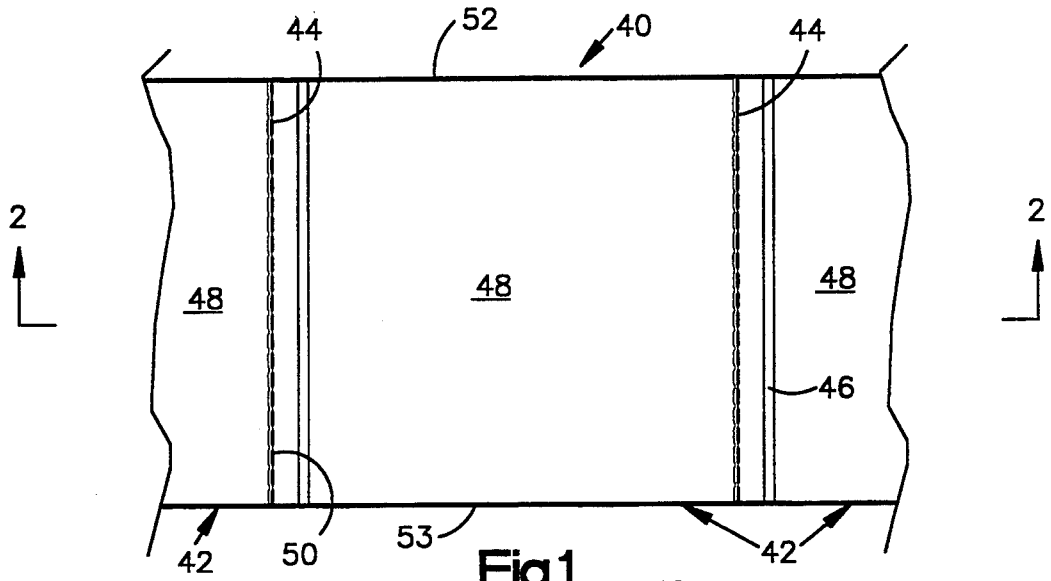
FIG. 1 is a fragmentary plan view of a section of a chain of interconnected bags made in accordance with invention.
Figure 2:
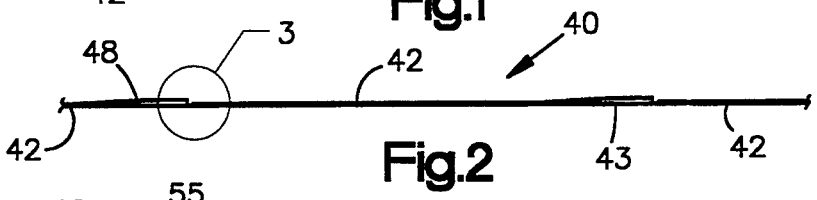
FIG. 2 is a sectional view of the chain of FIG. 1 as seen from the plane indicated by the line 2—2 of FIG. 1.
Figure 3:
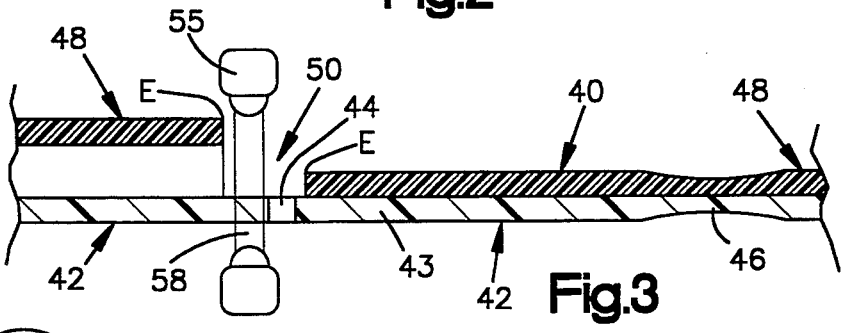
FIG. 3 is an enlarged sectional view of a section of the chain indicated by the circle 3 of FIG. 2.

Referring now to FIGS. 1 through 3, the novel container strip of this invention is shown generally at 40. The strip includes a plurality of interconnected bags 42 joined together in a back ply 43 by lines of weakness 44 in the form of perforations. Transverse seals 46 delineate the bottoms of bags.

The face ply formed by the web from the supply 10 is separated into individual bag face sections 48. A transversely extending bag opening 50 is adjacent the top of each bag face section 48. Each opening 50 extends completely across the web from one side edge 52 to the other 53, while the perforations in the back 43 remain intact. Each bag opening extends longitudinally of the web preferably at least 1/32 (one thirty second) of an inch.

The importance of the longitudinal extent of these openings is best understood by reference to FIG. 3. A conventional spark detector is shown schematically at 55. Assuming the web is moving from right to left in FIG. 3 so that the bags are being fed closed end first in a bagging machine, as is conventional, it will be seen that the detector 55 will readily be able to locate the perforations 44 once the spark path indicated schematically at 58 is aligned with the perforations.

OPERATION

In operation coils of single ply plastic are mounted to provide the front and back supplies 10, 12. The materials of the webs may be other than identical so long as they are capable of being sealed together. For example, one web may be pigmented such that it is translucent or opaque while the other web is clear. Typically the plastic will be polyethylene, although other thermal softenable plastics capable of adherence together on application of heat and pressure are sometimes employed.

Webs from the supplies 10, 12 are fed along their respective independent paths of travel through the tension control nip rolls 18, 20 to the juncture nips 17. They are then fed along the path 28 past the hot knives 22, 23, the transverse sealer 30, the perforator 32, the zinger 34 and thence to the take up 38.

Once the machine is set up and operation commences, the nips 18, 20 are adjusted to provide differential tension along the paths 14, 15. The appropriate tension is a function of the material, its thickness and its width.

Once appropriate tension has been at least provisionally established and temperatures of the hot knives and transverse sealer are adjusted to appropriate levels, production commences. Tension is further adjusted as the machine operates until desired finished products are consistently produced. During production the two plies are fed past the hot knives to create a tube with a front face stretched more than the back. This differential stretching is maintained as the now formed tube passes the transverse sealer and the perforator. Once the face web is opened by the zinging operation, the tension in the just opened web face section is released and it will shrink longitudinally of the web relative to the back to produce the desired opening of at least 1/32 (one thirty second) of an inch measured longitudinally of the web.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A process of forming a chain of pre-opened bags comprising:

a) independently feeding first and second plastic webs along individual paths of travel to a common path;

b) differentially tensioning the webs while in their independent paths by stretching the first web more than the second such that the first web which will form bag faces will retract longitudinally more than the second web upon release of the web tension;

c) while so differentially tensioned forming edge seals between the webs to convert the webs into a tube;

d) forming longitudinally spaced transverse seals between the webs to delineate bottoms of bags being formed;

e) forming transverse lines of weakness in said second web to facilitate separation of bags from the remainder of the web during a subsequent use; and f) releasing the tension in individual bag sections of said first web by forming longitudinally spaced transverse separations of the sections and thereby producing a space between each contiguous pair of said sections.

2. The process of claim 1 wherein transverse lines of weakness are concurrently formed in both webs and thereafter the lines of weakness in the first web are broken to form the transverse separations and thereby release the tension in the sections of the first web.

3. The process of claim 2 wherein the lines of weakness are perforations.

4. The process of claim 1 wherein the lines of weakness are perforations.

5. The process of claim 1 wherein the differential stretching is achieved while the webs are in their independent paths.

6. The process of claim 5 wherein each such space is at least 1/32 inch in dimension longitudinally of the web.

7. The process of claim 6 wherein the differential tensioning is maintained in those portions of the webs being joined by side seals.

8. The process of claim 5 wherein the differential stretching is accomplished by differential tensioning the webs while in their independent paths.

9. A process of forming a chain of interconnected and pre-opened bags comprising:

a) feeding a bag face web along an independent path of travel to a joint path of travel;

b) feeding a bag back web along a different independent path of travel to the joint path;

c) tensioning the webs as they are fed along their respective independent paths to differentially stretch the webs with the face web being stretched more than the back web;

d) forming side seals between the webs while so differentially stretched to form a tube;

e) delineating bag bottoms by forming transverse, longitudinally spaced seals between the webs;

f) forming face and back web pairs of transverse lines of weakness at longitudinally spaced locations with each pair of lines delineating a bag top;

g) zinging sections of the face web forming bag faces to tear the face web perforations and thereby open each bag; and h) releasing the web tension to allow the inherent resiliency of each web to achieve an unstretched condition and thereby produce a space between each bag face and its adjacent bag end whereby to provide a chain of easy open bags with easily detectable lines of weakness.

10. A process for forming an elongate chain of interconnected, preopened, plastic bags comprising:

a) forming an elongate flattened tube having juxtaposed face and back plies;

b) forming a series of spaced, bag bottom delineating, transverse seals between the plies;

c) forming transverse lines of weakness in the back ply spaced from one another at intervals corresponding to the spacing between the seals, each of the lines of weakness being near one of the seals to delineate ends of two contiguous bags being formed;

d) forming bag openings in the front ply, each bag opening being aligned with an associated one of the lines of weakness with each opening extending longitudinally of the web in both directions from its associated line of weakness a distance sufficient to assure detector access to the associated line of weakness; and, e) collecting a quantity of the formed interconnected bags into a dispensing arrangement comprised of a selected one of a coil and a festooned array.

11. The process of claim 10 wherein the longitudinal dimension of each opening is at least about 1/32 inch.

12. The process of claim 11 wherein each opening is substantially longitudinally symmetrical of its associated line of weakness.

13. The process of claim 10 wherein each opening is substantially longitudinally symmetrical of its associated line of weakness.

* * * * *

UNITED STATES PATENT AND TRADEMARK OFFICE

CERTIFICATE OF CORRECTION

PATENT NO. : 5,417,639

DATED : May 23, 1995

INVENTOR(S) : William M. Cronauer

It is certified that error appears in the above-indentified patent and that said Letters Patent is hereby corrected as shown below:

Column 5:

Claim 8, line 1, delete [5], substitute —9—.

Signed and Sealed this

Ninth Day of January, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,417,639

DATED : May 23, 1995

INVENTOR(S) : William M. Cronauer

It is certified that error appears in the above-identified patent and that said Letters Patent is hereby corrected as shown below:

In column 5:
Claim 7, line 1, delete [6], substitute -- 9 --; and,
Claim 8, line 1, delete [5], substitute -- 9 --.

Signed and Sealed this

Thirteenth Day of May, 1997

*Attest:*

*Attesting Officer*

BRUCE LEHMAN

*Commissioner of Patents and Trademarks*